United States Patent [19]

Livers et al.

[11] 4,249,046

[45] Feb. 3, 1981

[54] INERTIA SENSOR SWITCH

[75] Inventors: Gerald D. Livers; Douglas R. Schafer; Walter E. Thiele, all of Santa Barbara, Calif.

[73] Assignee: General Motors Corporation, Detroit, Mich.

[21] Appl. No.: 47,150

[22] Filed: Jun. 11, 1979

[51] Int. Cl.[3] ..... H01H 35/14

[52] U.S. Cl. ..... 200/61.45 R; 260/61.48; 200/61.49; 200/61.51

[58] Field of Search ..... 200/61.45 R, 61.45 M, 200/61.48, 61.49, 61.51, 61.52

[56] References Cited

U.S. PATENT DOCUMENTS

| | | | |
|---|---|---|---|
| 2,741,675 | 4/1956 | Chase et al. | 200/61.49 |
| 3,389,236 | 6/1968 | Guthart | 260/61.48 |
| 3,556,556 | 1/1971 | Goetz | 200/61.45 R X |
| 3,774,938 | 11/1973 | Orlando | 200/61.45 R X |
| 3,794,786 | 2/1974 | Doyle | 200/61.45 R |

*Primary Examiner*—James R. Scott
*Attorney, Agent, or Firm*—Herbert Furman

[57] ABSTRACT

A cantilever type velocity sensor which includes a unitary elongated frame member mounted on spaced walls of a base of dielectric material. A planar spring member has one end portion thereof mounted to an integral adjustable portion of the frame and the other free end thereof mounting a mass engageable with another integral adjustable portion of the frame. The first portion is adjustable to set the preload force and the second portion is adjustable to set the travel distance between the mass and the contact means of the sensor. A third integral adjustable portion of the frame limits vibrational movement of the spring member relative to the frame. A resilient stop means is engageable by the mass upon actuation of the sensor to obviate contact bounce and ensure adequate closure time. Both the contact means, in the form of a columnar coil spring, and an integral terminal portion of the frame, are monitored by a resistor connected thereacross.

3 Claims, 3 Drawing Figures

INERTIA SENSOR SWITCH

This invention relates generally to velocity responsive sensors for use with vehicle occupant restraint systems and more particularly to velocity responsive sensors of the cantilever type.

DESCRIPTION OF THE PRIOR ART

Cantilever type velocity responsive sensors are known. U.S. Pat. No. 3,774,938 Orlando, Velocity Responsive Sensor for Vehicle Occupant Restraint, issued Nov. 27, 1973 and assigned to the assignee of this invention, shows such a sensor.

Cantilever type sensors generally include an elongated planar leaf spring member having one end supported and the other free end mounting a mass which engages a stop to deflect the spring member relative to its supported end and thereby provide a preload force maintaining the mass in its normal unactuated position unless subjected to a predetermined change in vehicle velocity within a predetermined time frame. When the mass is subjected to the velocity change within the predetermined time frame, it moves relative to the stop to engage the mass or the spring member with a columnar coil spring and complete a circuit across a source of power and an inflatable occupant restraint system. While sensors of this type are useful with such systems, they likewise can be used with other systems which are intended to be actuated in accordance with a predetermined change in velocity occurring within a predetermined time frame.

SUMMARY OF THE INVENTION

The sensor of this invention has several improved features. One feature is that the planar spring member is adjustably mounted and located by a elongated frame. Another feature is that the planar spring member is mounted at one end thereof to an adjustable portion of an elongated frame, has the mass thereof engaging a second adjustable portion of the frame to locate the mass relative to the contact means, and is engageable intermediate the ends thereof with a third adjustable portion of the frame to limit vibrational movement of the spring member relative to the frame. A further feature is that the adjustable portions of the frame are integral therewith and spaced longitudinally thereof. Yet another feature is that the spring member wraps around the adjustable portion of the frame providing the mounting for the spring member, with an integral terminal portion of the spring member providing the electrical connection thereof to the control circuitry of the sensor to thereby minimize the number of electrical interconnects and enhance sensor reliability. Yet a further feature is that the frame is mounted on spaced walls of a base of dielectric material, with such spaced walls being connected by an integral base wall providing the support for the contact means, with the spring member and mass being movable between the spaced walls and toward one side of the base wall to engage the contact means, and with the terminal portion of the spring member extending to the other side of the base wall for electrical connection with the control circuitry. Still another feature is that the control circuitry includes a circuit board secured to the spaced walls to the other side of the base wall, with the terminal portion of the spring member and the contact means being soldered to the circuit board and being monitored through a resistor mounted on the circuit board and connected thereacross. Still a further feature is that the base wall includes a resilient stop means engageable by the mass to obviate contact bounce as well as ensure a predetermined closure time of the mass with the contact means.

These and other features of the sensor of this invention will be readily apparent from the following specification and drawings wherein:

DESCRIPTION OF THE PREFERRED EMBODIMENTS

As shown generally in FIG. 1, the sensor includes a mounting member 10, a cover 12, and a redundant sensor assembly 14 which is secured to the mounting member 10 as will be described prior to assembly of the mounting member 10 within the cover. The sensor assembly includes redundant sensors. Only one of the sensors will be particularly described and it will be understood that the other is of like construction unless otherwise noted.

Figure 1:
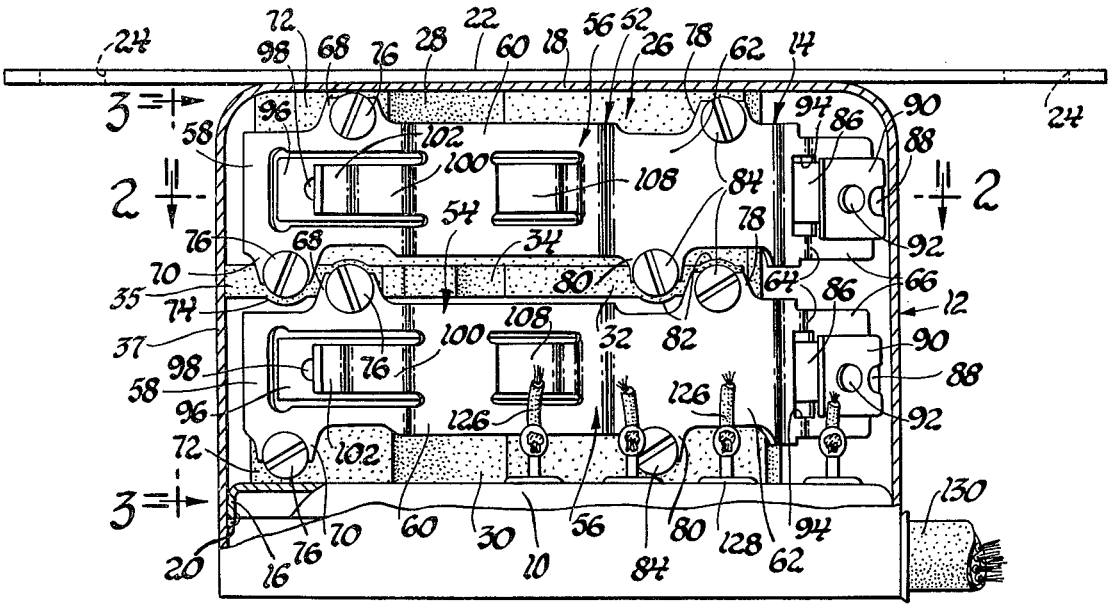
FIG. 1 is a partially broken away view of a sensor according to this invention.
Figure 2:
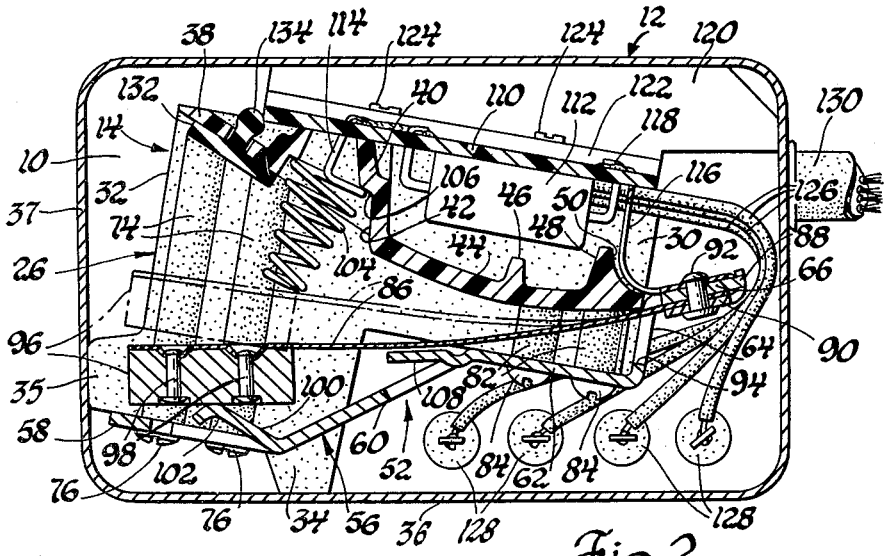
FIG. 2 is a sectional view taken generally along the plane indicated by line 2—2 of FIG. 1.
Figure 3:
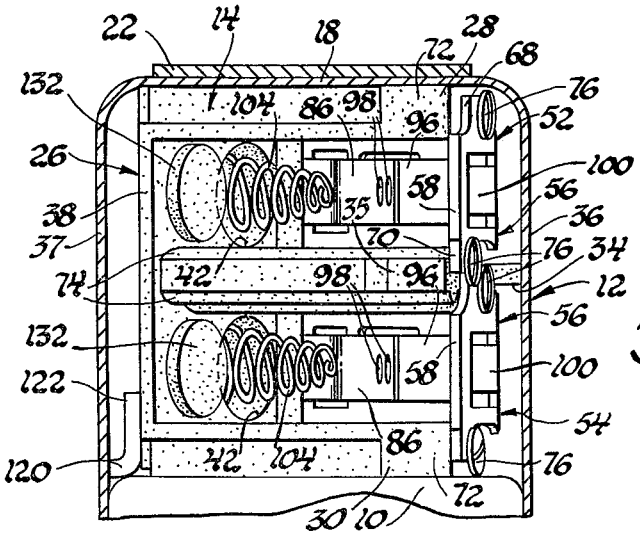
FIG. 3 is a partially broken away view taken generally along the plane indicated by line 3—3 of FIG. 1.

As shown generally in FIGS. 1 through 3, the member 10 is generally of rectangular shape and includes an integral flange or skirt 16. The cover 12 is likewise of generally rectangular shape and includes an integral closed end wall 18. After assembly of the sensor assembly 14 to the member 10, as will be described, the member 10 is fitted into the open end of the cover 12 and is soldered all the way around flange 16 to form a hermetic seal at 20. Secured to the wall 18 is a bracket 22 which is apertured at 24 in order to provide for mounting of the sensor on a device to be sensed, such as the radiator support structure or other relatively rigid portion of a vehicle.

The sensor assembly 14 includes a base 26 of dielectric material including integral outer side walls 28 and 30 and an integral intermediate side wall 32. As shown in FIGS. 2 and 3, the free edges of walls 28, 30 and 32 are generally transversely aligned except that wall 32 includes extensions 34 and 35 which respectively engage walls 36 and 37 of cover 12 in order to space the sensor assembly 14 within the cover. As shown in FIG. 2 the walls 28 and 30 are integrally interconnected intermediately thereof by a generally arcuate base wall 38. Wall 32 integrally terminates at wall 38. Wall 38 includes a generally frustoconical portion 40 adjacent one end thereof opening to a frustoconical bore 42 between the walls 28 and 32 and also between the walls 30 and 32. An arcuate base wall 44 extends to the other end of walls 28 and 30 and is reinforced by integral ribs 46 and 48, the latter having an arcuate surface 50. Wall 44 is also integral with wall 38 and with wall 32, the latter wall integrally terminating at wall 44. The pairs of walls 28 and 32 and 32 and 30, and the base wall 38 interconnecting each such pair, define respective bases for each of the redundant sensors.

Since the sensors are alike, only the sensor 52, FIG. 1, will be particularly described and it will be understood that the sensor 54 is of the same construction. An elongated unitary metal frame 56 includes portions 58, 60, 62, 64 and 66. Portion 58 includes laterally slotted ears 68 and 70 which respectively seat on an apertured reinforced portion 72 of wall 28 and an apertured boss 74 of wall 32. Screws 76 extend through the ears and into apertures to secure this portion 58 of the frame to the base 26. The frame portion 62 likewise has laterally slotted ears 78 and 80 which respectively seat on an apertured reinforced portion of wall 28, similar to portion 72, and on an apertured boss 82 of wall 32 and are secured thereto by screws 84. The portion 64 of the frame 56 seats against the end of wall 28 but does not engage the end of wall 32 since this wall terminates short of walls 28 and 30. Bosses 74 and 82 are staggered longitudinally of wall 32 to accommodate the staggered ears 70 and 68 and 80 and 78 of the frames 56 of the sensors 52 and 54 respectively.

An elongated planar spring member 86 fits between the walls 28 and 32 and is wrapped around the portion 66 of the frame as best shown in FIG. 2. The portion 66 is provided with an integral tab 88 which extends through a slot in the spring member 86 and a washer member 90 overlies the spring member and is bifurcated to straddle this tab 88. The washer member 90, the spring member 86 and the portion 66 are riveted together at 92 to thereby mount or secure one end of the spring member 86 to the frame. The portions 64 and 66 of the frame are slotted at 94 in order that the spring member can project through the frame to planar engage the portion 66 of the frame.

A rectangularly shaped mass 96 is riveted at 98 to the free other end of the spring member 86. An integral tab 100 of the frame 56 is lanced from portion 58 and provided with an arcuate rib 102 for engagement by the mass 96. This engagement controls the travel distance between the mass and the contact means which is in the form of a generally frusto-conically wound columnar type contact spring 104 seated on an annular wall 106, FIG. 2, between extension 40 and bore 42.

A second integral tab 108 of the frame 56 is lanced from portion 60 and located intermediately of the spring member 86 for engagement therewith in order to limit vibrational movement of the spring member 86 intermediate its mounted end and its free end supporting the mass 96.

A circuit board 110, FIG. 2, fits against extensions 40 and walls 28 and 30 and is secured to the walls by screws, not shown, extending into tapped bores of the walls. Mounted on the circuit board 110 are a pair of resistors 112, each respective to a spring member 86, as well as other components. The base wall 44 and the walls 28 and 30 define a cavity or housing, closed by the circuit board 110, for the pair of resistors 112. An integral terminal 114 of the contact spring 104 extends through the circuit board 110 and is soldered thereto and to one lead of a respective resistor 112. The integral terminal portion 116 of the spring member 86 extends around the arcuate surface 50 of rib 48, through the circuit board 110, and is soldered thereto and to the other lead of the respective resistor 112 at 118. Thus, the resistor 112 is connected across all of the solder joints of the contact spring 104 and spring member 86 to the circuit board for monitoring purposes.

A bracket 120 is secured to one side of the member 10 and has a lateral flange 122 which underlies the circuit board and is secured thereto and to wall 30 by screws 124 in order to mount the sensor assembly 14 to the member 10. The various leads 126 from the circuit board extend between the frames 56 to insulated connections 128 which provide for electrically connecting the leads to a wiring harness 130, FIG. 1, located to the other side of the member 10 and extending outwardly through the cover assembly 12. The connections 128 are soldered to the other side of the member 10.

The spring member 86 is shown in full lines in FIG. 2 in unactuated position, with the mass 96 in engagement with the rib 102 of tab 100 in order to set the travel distance between the mass end of the spring member and the contact spring 104. The preload force holding the mass against rib 102 is set by bending of the portion 66 relative to the portion 64 at the junctures joining these portions to either side of the slot 94. The vibrational movement of the spring member 86 relative to the frame 56 is limited by engagement of the spring member with the tab 108, which it will be noted, is located in generally parallel spaced relationship to the intermediate portion of the spring member.

Should the vehicle or other device on which the sensor is mounted be subjected to a predetermined velocity change within a predetermined time frame, the mass 96 and the spring member 86 will move from their full line position of FIG. 2 to their dotted line position shown therein wherein the spring member 86 opposite the mass engages and compresses the contact spring 104 to close an electrical circuit across a device to be actuated, such as an inflatable occupant restraint cushion.

It will be noted with reference to FIGS. 2 and 3 that the base wall 38 is apertured intermediate walls 28 and 32 and intermediate walls 32 and 30. A generally circular stop 132 includes an integral extension 134 provided with a bulbous end received through a respective aperture so as to be movably secured to wall 38. The stop 132 is formed of a low rebound material, such as certain types of plastics, and is engageable by the spring member 86 opposite the mass 96 upon compression of the contact spring 104 in order to minimize contact bounce and insure the necessary closure time of the spring member with the contact spring 104 required to actuate the electrical control system connecting the sensor assembly with the device to be actuated.

From the foregoing description, it can be seen that the frame 56 provides an elongated unitary support for the planar spring member 86 and that the tabs 100 and 108 respectively provide for locating the mass 96 a predetermined distance from the contact spring 104 and for limiting vibrational movement of the spring member relative to the frame. The portion 66 provides for adjustable mounting of the planar spring member on the frame and bending of this portion relative to the frame 56 permits adjustment of the preload force holding the mass 96 against the rib 102 of tab 100. By wrapping the spring member 86 around the portion 66 and providing the terminal portion 116 for connecting the spring member to the circuit board, the resistor 112 can monitor the solder connections of the spring 104 to the circuit board and of the terminal portion 116 to the circuit board. The arcuate base wall 44 provides a limit stop limiting bending movement of the spring member 86 upon engagement of the spring member with the coil spring 104 and compression of this spring. Additionally, this wall cooperates with the walls 28 and 30 in providing a housing or cavity for the monitor resistors 112.

Thus this invention provides an improved cantilever type sensor.

The embodiments of the invention in which an exclusive property or privilege is claimed are defined as follows:

1. A sensor comprising, in combination, a base including contact means, an elongated frame mounted on the base in spaced relationship to the contact means and including adjustable mounting means adjacent one end thereof and adjustable abutment means adjacent the other end thereof, an elongated generally planar spring member extending longitudinally of the frame and located intermediate the frame and the contact means, means mounting one end portion of the spring member to the adjustable frame mounting means, a mass secured to the other end portion of the spring member and engageable with the adjustable frame abutment means to deflect the spring member and locate the mass in spaced relationship to the contact means, the frame mounting means being adjustable to control the deflection of the spring member intermediate the ends thereof and the preload force biasing the mass into engagement with the frame abutment means, the abutment means being adjustable to control the travel distance of the mass to the contact means, and means on the frame engageable with the spring member intermediate the end portions thereof to limit vibrational movement of the spring member relative to the frame.

2. A sensor comprising, in combination, a base including contact means, an elongated frame mounted on the base in spaced relationship to the contact means and including integral adjustable mounting means adjacent one end thereof and integral adjustable abutment means adjacent the other end thereof, an elongated generally planar spring member extending longitudinally of the frame and located intermediate the frame and the contact means, means mounting one end portion of the spring member to the adjustable frame mounting means, a mass secured to the other end portion of the spring member and engageable with the adjustable frame abutment means to deflect the spring member and locate the mass in spaced relationship to the contact means, the frame mounting means being adjustable to control the deflection of the spring member intermediate the ends thereof and the preload force biasing the mass into engagement with the frame abutment means, the abutment means being adjustable to control the travel distance of the mass to the contact means, and means on the frame engageable with the spring member intermediate the end portions thereof to limit vibrational movement of the spring member relative to the frame.

3. A sensor comprising, in combination, a base including a wall and contact means to one side thereof, an elongated frame mounted on the base in spaced relationship to the one side of the wall and the contact means and including an adjustable mounting portion adjacent one end thereof and adjustable abutment means adjacent the other end thereof, an elongated generally planar spring member extending longitudinally of the frame and located intermediate the frame and the base, the spring member being wrapped around the adjustable frame mounting portion and having a terminal one end portion extending to the other side of the frame wall for connection to circuit means, a mass secured to the other end portion of the spring member and engageable with the adjustable frame abutment means to deflect the spring member and locate the mass in spaced relationship to the contact means, the frame mounting portion being adjustable to control the deflection of the spring member relative to the frame and the preload force biasing the mass into engagement with the frame abutment means, the frame abutment means being adjustable to control the travel distance of the mass to the contact means, and means on the frame engageable with the spring member intermediate the frame mounting portion and abutment means to limit vibrational movement of the spring member relative to the frame.

* * * * *